US005708627A

United States Patent [19]

Gormley

[11] Patent Number: 5,708,627

[45] Date of Patent: Jan. 13, 1998

[54] ELECTRONIC CLOCK AND CALENDAR APPARATUS WITH AUDIO MESSAGE RECORDING AND PLAYBACK

[76] Inventor: Stuart G. Gormley, 1805 Mission Blvd., Santa Rosa, Calif. 95409

[21] Appl. No.: 298,149

[22] Filed: Aug. 30, 1994

[51] Int. Cl.[6] ..... G04B 45/00

[52] U.S. Cl. ..... 368/10; 368/41; 368/72; 368/251

[58] Field of Search ..... 368/40–49, 243–251, 368/272–275, 10, 72

[56] References Cited

U.S. PATENT DOCUMENTS 4,835,520 5/1989 Aiello ..... 368/10
4,894,813 1/1990 Pacher et al. ..... 368/256
5,195,061 3/1993 Curtis et al. ..... 368/9
5,309,145 5/1994 Branch et al. ..... 368/11

*Primary Examiner*—Bernard Roskoski
*Attorney, Agent, or Firm*—Zarley, McKee, Thomte, Voorhees & Sease

[57] ABSTRACT

An electronic device that stores audio messages entered by the user onto digital chips. Each recorded message is addressed with a chronological code that enables a microprocessor to access the memos according to specific times. When the code used to record the memo matches the current time and day or date, the memo is downloaded into an immediate access file. A proximity detector provides a signal to the microprocessor when a presence is detected, activating playback of the memos in the immediate access file, unless modified by suppression programming. The apparatus may further include a light sensor to activate a given message when ambient lights are turned off.

11 Claims, 2 Drawing Sheets

ELECTRONIC CLOCK AND CALENDAR APPARATUS WITH AUDIO MESSAGE RECORDING AND PLAYBACK

BACKGROUND OF THE INVENTION

1. Field of the Invention

This invention relates generally to calendaring and recording devices, and more specifically to an improved electronic clock and calendar apparatus with audio message recording and playback capabilities.

2. Description of the Prior Art

Calendaring and recording devices are well known and in widespread use. Some such devices utilize well-known microprocessor technology to enable the user to record a given message for retrieval or display on a specific future date. However, known devices of this type are complex, cumbersome, or otherwise not suitable for widespread consumer use, nor do they enable automatic and programmable playback by the user.

SUMMARY OF THE INVENTION

The electronic clock and calendar apparatus of this invention provides an electronic device that stores voice memos (audio messages) entered by the user onto digital chips. Each segment of stored voice is addressed with a code that makes it possible for a microprocessor to access the memos randomly. Along with these stored memos, chronological codes that correspond to time of day, days, dates, months, and years can be stored. This allows the apparatus to record and access memos for very specific times.

The apparatus contains an electronic calendar (within the microprocessor and utilizing well-known technology) that keeps track of the time of day, days, dates, months, and years by assigning codes to each. It then uses these codes to search for memos that are recorded under the same codes. When the codes used to record the memo matches the current time and day or date, the memo will be downloaded into an immediate access file.

The apparatus is equipped with a proximity detector (or motion detector) that provides a signal or stimulus to the microprocessor. When the microprocessor receives the stimulus (e.g., someone moving in the room) it will play all the memos in the immediate access file, unless modified by suppression programming.

The apparatus may further include a light sensor or "photoelectric eye" to activate a given message (e.g., a nighttime memo), when ambient lights are turned off. In this way, the apparatus can remind a user of an important memo just before he or she retires for the evening.

DETAILED DESCRIPTION OF A PREFERRED EMBODIMENT

Figure 1:
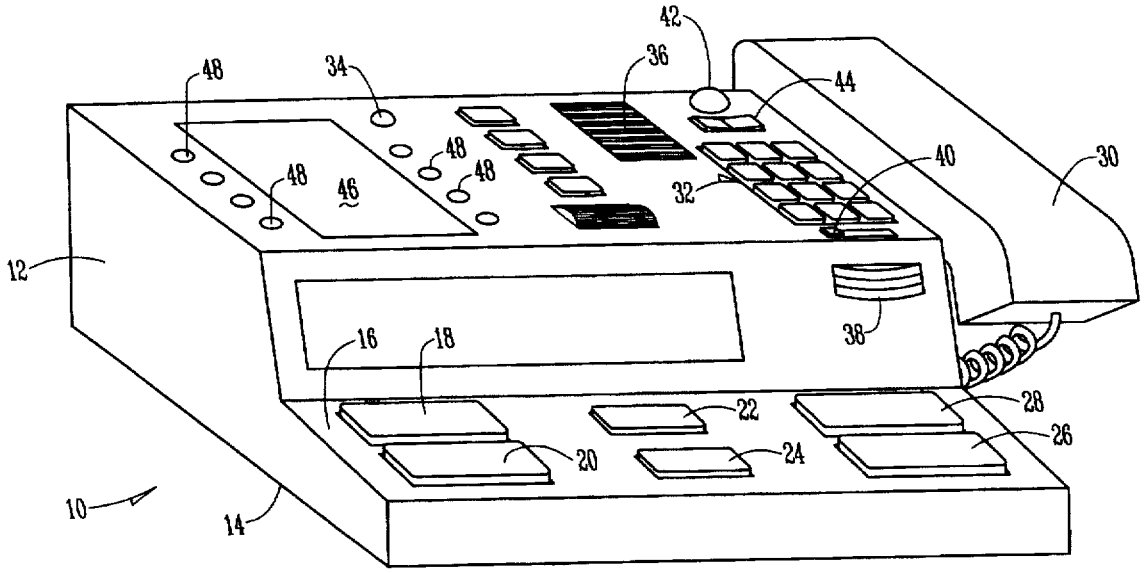
FIG. 1 is a perspective view of an electronic clock and calendar apparatus of this invention, illustrating the outwardy visible components and controls including an external housing, a clock display and clock controls including a morning memo, night memo, alarm set, time set, snooze and cancel, a telephone handset and telephone keypad, a microphone, a speaker, a proximity detector and associated control switch, a photoelectric sensor and associated control switch, and a system operating screen and associated control keys.

FIG. 1 is a perspective view of an electronic clock and calendar apparatus 10 of this invention, illustrating the outwardy visible components and controls including an external housing 12, a clock display 14 and clock controls 16 including a morning memo 18, night memo 20, alarm set 22, time set 24, snooze 26 and cancel 28, all operating in the traditional manner or as described herein. The apparatus further includes a telephone handset 30 and telephone keypad 32, a microphone 34, a speaker 36, a proximity detector 38 and associated control switch 40, a photoelectric sensor 42 and associated control switch 44, and a system operating screen 46 and associated control keys 48, again all operating in the traditional manner or as described herein.

Figure 2:
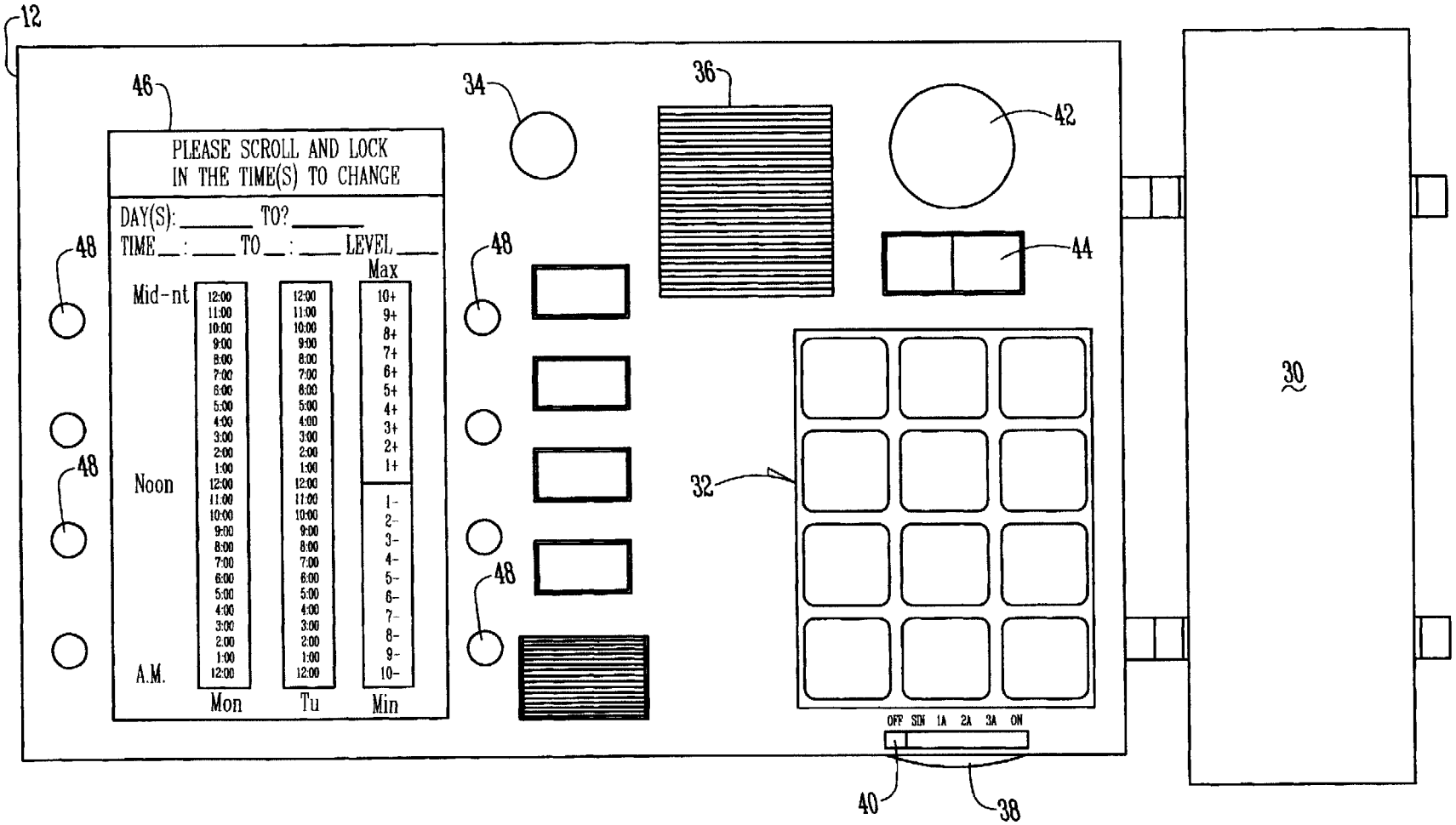
FIG. 2 is a top plan view of a portion of the electronic clock and calendar apparatus of this invention, further illustrating the system operating screen and associated control keys.

FIG. 2 is a top plan view of a portion of the electronic clock and calendar apparatus of this invention, further illustrating the system operating screen 46 and associated control keys 48.

The inventive apparatus may include some or all of the following features:

MEMO PLAYBACK CONTROL: The apparatus contains programming that modifies when the recorded memos can play. This is suppression programming known as time cycle delay. This causes the microprocessor to count down intervals of time during which it will ignore stimuli from the proximity detector. When the microprocessor has finished counting the time interval it will accept stimuli from the proximity detector. Once the microprocessor receives a stimulus it will play all the memos in the immediate access file; after it has done this it will return to counting down the interval of time. These time intervals can be varied by the operator. The variation can be different for each day of the week and it can be different several times during the day. The purpose of this is to cause memos to play more or less frequently during the times the operator desires.

The apparatus contains an automatic four day pre and two day post warning function (these can also be changed by the operator). This modifies when all memos recorded with a specific date(s) will be played. For instance if a memo is recorded for the fourteenth of the month it will be downloaded into the immediate access file on the tenth, as well as on the fourteenth. It will also stay in the immediate access file until the sixteenth. Whenever a memo with a specific date is played on a date other than the date it was recorded for, the apparatus will announce the date it was recorded for before playing the memo.

Memo playback and repression also occur in other ways. The apparatus is equipped with an alarm clock; when the alarm is shut off in the morning the memos prompted for play on that day will play. In addition a memo called the "morning memo" will play. The "morning memo" is recorded with a separate button labeled "morning memo". Memos will also play when one turns off the lights in the room. The apparatus is equipped with a photoelectric eye for this purpose (this electric eye can be calibrated to activate memos for varying levels of light). A memo called the "night memo" will also play when the light is shut off. This memo is recorded with a separate button labeled "night memo". The photoelectric eye serves another function. After the memos have played when the lights in the room have been turned off, if the photoelectric eye is in the "no light, no play position", no memos will be played in the absence of light. A light in the room must be on for ten minutes before the apparatus will resume normal memo play back functions. The purpose behind this is to prevent memos from playing while someone is asleep and waking them up (such as someone getting up to get a drink of water or to come to bed late). Their movement won't cause the apparatus to activate and wake the other person.

Memo playback will also be modified if the operator has chosen for a memo to be a confidential memo. In this case a code will have to be punched in to hear the memo. When a confidential memo has prompted up for play one of two things will happen. If you have chosen the beep (audio) mode, the apparatus will beep when the proximity detector is set off. If the light (visual) mode is selected, a small light will flash on and off when the proximity detector is set off. To hear the memo the operator must go up to the apparatus, pick up the phone receiver, punch in their access code (the same code the apparatus will ask the operator to punch in when one chose the confidential option) and press play. The memo will be heard over the phone receiver.

The apparatus is equipped with an immediate memo function. Again it is possible to use this function over the phone or through the apparatus itself. The immediate memo is a memo that ignores the time cycle delay and runs on its own fixed minute time cycle delay (e.g., 30 minutes). When the proximity detector is set off the memo will play (if the cancel button is pressed at this time this memo will not replay), unless the operator has chosen for the memo to be coded. If the message is coded (one must have already entered the code one wants to use, under the name and code storage screen) the apparatus will announce "I have a message for (your name here)," and will take the name from the name and code storage screen. To hear the memo the person it was intended for must pick up the phone receiver, punch in their access code and press play. All memos that are recorded in the apparatus with specific dates that are not saved will be erased fifteen days after the day they were recorded for (note: the post warning function must expire before the fifteen-day count down can begin). Although no date is entered for the immediate memo, the apparatus will assign a date to this type of memo (the date it was recorded).

MEMO CALENDARING: When recording a memo on the apparatus it is a function of going from the less specific to the more specific. The more time intervals one chooses for a specific memo, the more specific its playback time will become. For example, one can record a memo just using a day of the week such as Thursday. If one does, this memo will prompt up for play every Thursday (if one saved it when one recorded it or saved it under the search for a memo screen later). If one records and saves a memo for the fifteenth it will play on the fifteenth of each month. If one records a memo for Thursday the fifteenth this memo will play on Thursdays that also fall on the fifteenth of each month. This pattern of memo playback is consistent for all time interval options in the apparatus, except for memos recorded for rotating days of the month. The apparatus allows one to record memos that will play on rotating days of the month such as the first and third Wednesday of the month. Instead of relying on dates in this mode, the apparatus will count the elapsed number of a particular day(s) from the beginning of the month so as to tell when a particular memo should be downloaded.

Memos recorded for a specific hour such as 8:00 or 8:30 p.m. do not rely on proximity or motion detector stimuli to download for play, but rather rely on the internal clock to download and play. This type of memo will only start playing at the time it was recorded for. These types of memos are affected by a repeat function. Depending on what the operator sets, time specific memos will repeat every x minutes for y amount of time. Once a time specific memo starts playing it can be acknowledged in one of two ways. With a switch the operator can choose either proximity detector or cancel. In the proximity position once the memo plays all one has to do is in some way move a little closer to the apparatus (i.e., within sensing range of the proximity detector). This will acknowledge the memo and it will not repeat, unless it has been saved; in this case it will play the next time this particular time comes up. In the cancel position one has to go up to the apparatus and press a button labeled "cancel".

MESSAGE DELIVERY BY TELEPHONE: The apparatus can also deliver messages over the phone. After recording a memo under the "record a memo screen" the apparatus will ask the operator "call this memo in, Yes/No?" If the operator chooses "yes", he/she will be asked a series of questions that will let the apparatus know when to call and what number(s) to call. When the apparatus calls, the operator will hear one of two things depending on if the operator has chosen this memo to be coded or not. If the operator has chosen a coded option he/she will hear, "I have a message for (your name here), please enter your code". This greeting will play in a continuous loop until the proper code is punched in. Your name is recorded and stored under a name and code storage screen. It accesses your name by matching it with the code one must punch in when one chooses for this memo to be coded. The numbers the apparatus calls are stored under a number storage screen. Under this screen, there is a provision for the operator to designate a number as a pager number, if the operator does, the apparatus will ask the operator to punch in a phone number using the phone key pad. Now, instead of a voice message being delivered, a phone number will be transmitted to your pager. The purpose behind this is to remind one to call a number at a certain time.

If the operator chooses not to have the message coded, the apparatus will say "I have a message, please press 1 to receive messages". When the apparatus tries to deliver messages, it will go through the list of numbers on the number storage screen, (there are several different number storage screens all stored under different codes, there is also a provision to add new numbers to these screens directly from the "record a memo screen") the operator has designated with their code. It will try each number in turn. If after trying the last number if it still has been unsuccessful in delivering the message it will try the first number on the list again, if it is still unsuccessful it will give up. If the operator chooses the no code option the apparatus will ask "How many times should I try?" The apparatus will try every x minutes to deliver this message. It will try y number of times depending on what variable one has chosen. After that it will give up. Note, the apparatus will also ask "should this message be delivered to each number?" If you choose yes the same message will be delivered to each number and the apparatus will not stop after successfully delivering the message to one of the numbers. It will only stop after the number of times to try has elapsed, and will not re-dial a number it was successful in delivering a message to.

After the apparatus has delivered a memo over the phone it will give one the option of leaving a return message by saying "Please press the star key (*) to leave a message." If one leaves a message it will go on the answering machine section of the apparatus. After ten seconds if no button has been pressed the apparatus will ask you to punch in your access code to use the other features, unless this was a coded message, in this case it will just start playing any messages that have been phoned in. Then it will start playing any other apparatus memos that have prompted up for play on this day.

If the line remains open the apparatus will start talking the operator through other options such as: "Press 1 to replay messages," "press 2 to erase messages," "press 3 to record a memo," "press 4 to record a new general greeting," "press 5 to record a personal greeting," "press 6 to hear memos," "press 7 to record an immediate memo," "press 8 to access phone directory," "press 9 to add a number to the phone directory," "press #1 to use the wake up call". Under the answering machine options the operator can choose to have the apparatus call when it receives messages from callers.

VOICE MAIL: The apparatus has several functions that can be used over the phone or through the apparatus. The apparatus is capable of recording personal greetings. A personal greeting is a greeting that can be used by a person you have given a code to in advance (codes can be from one to five numbers). Personal greetings can be recorded over the phone (press number 5) or through the apparatus. During the general greeting if the caller punches in their personal code, they will hear the greeting you have recorded just for them. If during the general greeting the pound key (#) is pressed the general greeting will repeat. This allows the apparatus to be used as a mini voice mail system, if you record different segments of information under the personal greeting codes and ask the caller to press a certain button to hear some sort of information. After hearing the greeting the apparatus will give them the option of leaving a return message. One can hear the responses to a personalized greeting by pressing the code of the personalized greeting and pressing play. You will only hear the response to this particular greeting. You can also erase the responses to a particular greeting by punching in the code and pressing erase.

There is also a segmented general greeting function. Under this function it is possible to record the greeting in five different segments. In this way you can record and erase segments selectively, so if you want to change something in the greeting you won't have to record the whole thing over again. Each segment can be as long as you want. The apparatus will automatically compress the segments together and play it as one greeting.

Many different personal greetings can be recorded under different codes. The codes can be chosen by the people who will use them. The codes will be stored under a personal greeting screen along with their names. Names can be entered by pressing a two-key combination on the phone key pad (the names will appear on a liquid crystal display). For instance to enter the letter "S" one must press the numbers 7 and 3 (the letter "S" appears on the number seven button in the third position). In this way all letters of the alphabet can be entered (all names and codes will appear behind the numbers in the order they were recorded).

It is also possible to punch in your personal code at the time you record a personalized greeting number. With this option when messages are left in response to a personalized greeting the apparatus will pull your name from the "name storage screen" and announce who the messages are for by saying "there are phone messages for (your name here)". The apparatus can do this for all types of messages as long as your personal code is input at the time the memo is recorded so it will know who it is for. So now when you record a memo the apparatus will ask "who is this message for"? If you input a code, the apparatus will announce who it is for when the proximity detector is set off. In this way you won't waste time listening to messages that are not for you.

Instead of just saying "there are messages", the apparatus will announce what type of message it is; such as "there are phone messages" or "there are Voice Calendar memos". You can then decide if you want to listen.

MEMO DIRECTORY: The apparatus can store memos is alphabetical order. This makes it possible to store and retrieve information such as phone numbers, addresses, etc. To store information in this way, go under the phone directory screen (number 9 over the phone). All information recorded under this option is stored and accessed in alphabetical order and in numerical order automatically. To start storing information under this option the operator must enter a letter or letters (using the same method described earlier). Once one has entered all the letters one wants to use to store your information under, press record and record the first or last name of the person one is recording information about (first name for people you know personally and the last name for people you know formally). After recording the name continue holding the record button and record any other information one wishes, such as phone numbers, addresses etc. Once you let up on the button you should hear what you just recorded, and if it isn't what you wanted just press record again and the previous recording will be recorded over. To retrieve information (number 8 over the phone) the operator must enter the letter they want to search under and press the star key (*). The apparatus will start playing all the memos recorded under this letter or letters in the order they were recorded. The first thing one will hear is either the first or last name. If this isn't the information one wants, press the pound key (#) to scroll forward and the star key (*) to scroll in reverse. Using this method it is possible to scroll through all information recorded under this option. This option can be used over the phone or through the apparatus.

REMOTE PHONE WAKE-UP CALL: The apparatus can turn any phone into an alarm clock (to access this function press #1). When you use this option you will be asked the following information: the phone number to call, the time to call (using * for a.m. and # for p.m.), the number of rings and the number of days to continue calling this number. When the apparatus calls this number it will ring the number of times one has specified, so you won't have to pick up the phone and be charged a toll.

SECURITY SYSTEM: The apparatus can act as a supplemental security system. After you specify the hours and days you want the security system to be active, you will punch in your code so the apparatus will know what list to pull from when it calls. The apparatus will call you if it detects motion. Once it has called, it will announce "I have a security alert at (your name here) house" (again the apparatus has taken your name from the name and storage screen). After this has happened you will have an open mike into your house. This will allow you to hear what is going on. This will help you to decide if you want to call the police. If you come home early you should enter your access code and press cancel, so the apparatus won't call. If you go on vacation, you can enter a neighbor(s) number(s) and they will receive the security alert and take the necessary action. The apparatus will call all the numbers on the screen you have designated with your code. If no one answers within six rings it will go on to the next number in the list. It will continue to try the numbers on the list until it gets a response.

ALARM CLOCK: The apparatus is a fully functioning alarm clock. Time and alarm setting are set using the phone key pad (using the star key (*) for a.m. and the pound key (#) for p.m.). The rest of the alarm functions are separate buttons, such as a snooze button, alarm on/off, time set button and alarm set button.

HEALTH/SAFETY ALERT (NON-ACTIVITY ALERT): The apparatus can act as an alert of trouble for the elderly or handicapped who are living alone. Under the trouble alert screen it is possible to set a varying interval of time, such as twenty-four hours. The microprocessor will count this time interval down. Any motion that it detects will cause the countdown to reset. If for some reason the entire countdown elapses because no motion has been detected, the apparatus will access a "phone number screen" (a code that relates to a phone number screen must be punched in when you record the message) and start calling them in order delivering a prerecorded message (a message that is recorded by the operator). For example, the message may be "no motion detected in the last twenty four hours, please check on me at (name, number and address here)." Of course one will want the numbers that the apparatus is calling to be friends and relatives or a hospital.

EMERGENCY CALLING: In an add-on feature the apparatus will be capable of accepting a radio or infrared transmission that will activate one of two or both calling screens (depending on which option the operator activates), a police emergency calling screen and a medical emergency screen (appropriate messages should be recorded for each screen). The purpose behind this is to allow the operator to wear a small transmitter (perhaps in a wrist watch form) or to leave a small transmitter by the bed and activate these options in case of an emergency.

PHONE ANSWERING MACHINE: The apparatus can be used with an existing answering machine. When hooked with an answering machine the apparatus picks up on the line when the answering machine does. If the access code for the apparatus is punched in the apparatus using a relay will hang up on the answering machine. If the access code for the answering machine is punched in the apparatus will listen on the line passively. The apparatus should be hooked into the phone line closer to the wall jack than the answering machine.

The apparatus is equipped with a rotating greeting feature. Under the "record a greeting" screen the apparatus will ask you "how many greetings would you like to record 1–5?" After you punch in the number of greetings you want, the apparatus will say "please record your first greeting". After you record your first greeting the apparatus will say "please record your second greeting", etc. Now the apparatus will randomly play one of the greetings each time someone calls. There are two purposes behind this feature. The first purpose is that people get tired of hearing the same greeting each time they call. The second reason is that burglars will call your home when they are "casing it", if your greeting keeps changing each time a call is received, they will think you are changing it manually, and believe that you are home.

MEMO SEARCHING: The apparatus has features that allow the operator to search for memos using different search options. The operator can search for memos recorded on specific days, dates, hours, months, access codes and years. It is possible to search for a memos using as few of the search options one wants or as many as one wants. For instance, if you recorded a memo for Friday, July 29. The operator won't have to punch in the entire date. If Friday is the only thing punched in this memo will be brought up. When the apparatus finds memos under a search key the display will look something like this if five memos were found under this search key: "1 of 5". If the first memo has been saved a small "s" will appear next to the 1 (1s). If the memo is a confidential memo a small c will appear next to the 1 (1c); (1s,c) is a saved confidential memo. If you want to hear the first memo all the operator has to do is press play. If the memo is confidential the code must be entered before the memo can be heard. If while still under this search key another confidential memo comes up with the same access code the (c) will blink on and off. It will not be necessary to re-enter the access code to hear the memo. If however a memo comes up and the (c) is not blinking then this memo is under a different code, it will be necessary to enter this code to hear this memo. To move on to the next memo just use the scroll knob to move forward (or backward). The next memo will appear as: "2 of 5". It is possible to save a memo, erase a memo or make a memo confidential under this screen.

SENSITIVITY CONTROL: The apparatus is equipped with a multifunction proximity detector. The operator can change settings that will cause the apparatus to ignore T.C.D. at closer ranges. The proximity detector will have different settings, such as: on, off, six inches, one foot, two feet, three feet. In the on position the apparatus will act normally, adhering to the time cycle delay. In the off position the proximity detector won't send any signals to the microprocessor, in this position memos will only play in the other ways described. In the six inch setting the apparatus will ignore the time cycle delay when someone comes within six inches of the apparatus and play the memos prompted for play on that day. The one, two and three feet settings work the same way. The purpose behind this is to allow someone not to be bothered by the memos continuously playing while they are moving around in the room; but they can put the apparatus by the door and always hear the memos as they come and go.

DUAL PHONE LINE: The apparatus may also include an additional telephone line (two line hook up). With this addition when you look up a phone number under the phone directory screen, you can punch in a code such as #3 and the apparatus will automatically dial the number and connect you using the other line. This would require you to punch in the phone number with the key pad when you record your information for the phone directory. The advantage to this is if you are at a phone booth and don't want to use a calling card (e.g., because it may cost more to use it than a regular call) you can call the apparatus and have it connect you and the long distance charges will go on the line the apparatus is hooked to. This will also help if you are at a friends or business associates house and don't want to put the charges for a long distance on their phone. It could also help if the apparatus is at your business phone and you are at home but you want the charges for a business call to go on the business phone. It will also save you time if you didn't have the number and had to look it up, you won't have to hang up the phone and re-dial.

CALL FORWARDING: The apparatus will be capable of forwarding calls in two ways. In the first way, you will call the apparatus and press #4. The apparatus will ask you the number to forward to and the code to forward (this is the personalized greeting code). When this code is punched in the apparatus will know whose calls to forward and whose calls not to forward. The apparatus will then ask "please enter the amount of time to forward calls". At the prompt you enter the amount of time using the star key for hours (*) and the pound key for days (#). So if you press "*, 5" calls will be forwarded for the next five hours. If you press "#, 5" calls will be forwarded for the next five days. Of course you will be able to call up and cancel the forwarding for any particular code. The other way the apparatus allows you to forward calls is to be able to set up a forwarding schedule. The apparatus will have a menu item that states "set a forwarding schedule?" If you choose this option the apparatus will ask "which code(s) should I foreword?" At this prompt you can enter one or more codes. So when someone calls and enters one of the same codes you entered their call will be forwarded. The codes you enter can either be announced on the general greeting or not. If you leave a code off the general greeting it is assumed that you have given this code to someone in advance like a friend or family member. This will allow them to reach you directly when others cannot. In this way you can customize the type of calls you want to be forwarded. The apparatus will also ask you what times during each day to forward calls and to which numbers. The times to forward can be different for each day of the week and so can the numbers to forward to. This can be useful, if you work out of different offices on different days of the week.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A programmable electronic clock and calendar apparatus comprising:

a device for recording and automatic playback of at least one recorded message;

a microprocessor connected to said device for assigning a chronological code to each of said at least one recorded message and delivery of said message to an access file upon occurrence of its assigned chronological time;

a proximity detector connected to said microprocessor for detection of an operator presence and automatic initiation of playback of said at least one recorded message in said access file; and delay means for temporarily disabling said automatic initiation of playback of said at least one recorded message within a certain amount of time after a previous playback of said at least one recorded message so that the operator will not hear the recorded message successively unless said certain amount of time has elapsed since the most previous playback.

2. The electronic clock and calendar apparatus of claim 1 further including an external housing connected to said device, microprocessor, and proximity detector.

3. The electronic clock and calendar apparatus of claim 1 further including a clock display and clock controls connected to said microprocessor.

4. The electronic clock and calendar apparatus of claim 1 further including a telephone handset and telephone keypad connected to said microprocessor.

5. The electronic clock and calendar apparatus of claim 1 further including a photoelectric sensor connected to said microprocessor to initiate playback of a recorded message upon reduction in ambient light.

6. A method of storing and automatically playing audio messages comprising the steps of:

(a) providing a programmable message storage and playback device;

(b) recording an audio message on said repogrammable message storage and playback device;

(c) programming said programmable message storage and playback device to associate said audio message with a certain time in the future at which it is desired to play said audio message;

(c1) programming said programmable message storage and playback device to set a time cycle delay to a desired amount of time relating to a minimum amount of time in which a user desires to hear said audio message a successive time;

(d) determining whether said certain time has arrived;

(e) sensing motion in the proximity of said device;

(f) automatically playing said audio message if said certain time has arrived and if motion is sensed in the proximity of said device; and (g) repeating steps (e) and (f) after an amount of time has elapsed from the time the audio message was automatically played equaling the desired amount of time programmed into said time cycle delay unless the user disables the message playback.

7. The method of claim 6 further comprising the steps of:

providing a photoelectric sensor connected to the programmable message storage and playback device for sensing ambient light;

sensing the amount of ambient light in the proximity of the programmable message storage and playback device to provide an indication of when a user of the programmable message storage and playback device has turned off a light; and automatically playing said audio message if a reduction in the amount of ambient light is sensed.

8. The apparatus of claim 1 wherein said certain amount of time is adjustable by the user.

9. The apparatus of claim 1 wherein said proximity detector includes an adjustable sensitivity control for allowing the user to adjust the sensitivity of said proximity detector.

10. A programmable clock and calendar apparatus comprising:

a device for the recording and automatic playback of audio messages;

a processor connected to said device for controlling the recording and automatic playback of audio messages and associating each audio message with a programmed chronological code relating to a certain time in the future as selectively programmed by a user, said processor enabling the automatic playback of any audio messages which are associated with a chronological code relating to the present time;

a motion detector connected to said processor for detecting the presence of motion in the proximity of the apparatus and initiating the automatic playback of any enabled audio messages in response to the detected motion;

a timer electrically connected to the processor for counting down intervals of time after the automatic playback of any enabled audio message wherein the intervals of time are selected by the user by programming a desired time into the processor, and wherein the processor ignores any further detected motion until the timer completes the count down of the intervals of time; and a phone line interface connected to said apparatus for allowing said apparatus to communicate over a phone line.

11. The clock and calendar apparatus of claim 10 wherein any of said messages played back are played back over said phone line.

* * * * *